US007064729B2

(12) United States Patent
Olson

(10) Patent No.: US 7,064,729 B2
(45) Date of Patent: Jun. 20, 2006

(54) OMNI-DUALBAND ANTENNA AND SYSTEM

(75) Inventor: Steven C. Olson, Broomfield, CO (US)

(73) Assignee: ARC Wireless Solutions, Inc., Wheat Ridge, CO (US)

( * ) Notice: Subject to any disclaimer, the term of this patent is extended or adjusted under 35 U.S.C. 154(b) by 0 days.

(21) Appl. No.: 10/953,694

(22) Filed: Sep. 29, 2004

(65) Prior Publication Data

US 2005/0073465 A1 Apr. 7, 2005

Related U.S. Application Data

(60) Provisional application No. 60/507,627, filed on Oct. 1, 2003.

(51) Int. Cl.
*H01Q 1/38* (2006.01)
*H01Q 5/02* (2006.01)
*H01Q 21/12* (2006.01)
*H01Q 21/30* (2006.01)

(52) U.S. Cl. ..... 343/795; 343/812; 343/816; 343/890

(58) Field of Classification Search ..... 343/810–819, 343/890, 844, 795
See application file for complete search history.

(56) References Cited

U.S. PATENT DOCUMENTS

| | | | |
|---|---|---|---|
| 4,410,893 | A | 10/1983 | Griffee |
| 5,087,922 | A | 2/1992 | Tang et al. |
| 6,020,861 | A | 2/2000 | Jonsson et al. |
| 6,211,841 | B1 | 4/2001 | Smith et al. |
| 6,295,028 | B1 | 9/2001 | Jonsson et al. |
| 6,417,816 | B1 | 7/2002 | Sadler et al. |
| 6,734,828 | B1 | 5/2004 | Shor |
| 6,741,219 | B1 | 5/2004 | Shor |
| 6,747,605 | B1 | 6/2004 | Lebaric et al. |
| 2001/0011964 | A1 | 8/2001 | Sadler et al. |
| 2002/0171601 | A1 | 11/2002 | Baliarda |
| 2004/0085250 | A1 | 5/2004 | Tillery |
| 2004/0145526 | A1 | 7/2004 | Baliarda et al. |

FOREIGN PATENT DOCUMENTS

| | | |
|---|---|---|
| WO | WO 99-59223 | 11/1999 |

*Primary Examiner*—Michael C. Wimer
(74) *Attorney, Agent, or Firm*—Ancel W. Lewis, Jr.

(57) ABSTRACT

An omnidirectional dual band antenna system includes a radome and an antenna in the radome. The antenna has a linear array of lower frequency band driven elements, a linear array of higher frequency band driven elements and a linear array of parasitic elements, spaced in parallel planes with the array of higher frequency band driven elements in the middle. The parasitic elements couple to the higher frequency band driven elements and reshape the radiation pattern of the higher frequency band driven elements to correct for distortion caused by the lower frequency band driven elements.

16 Claims, 3 Drawing Sheets

OMNI-DUALBAND ANTENNA AND SYSTEM

This application claims the benefit under 35 U.S.C. § 119(e) of the U.S. provisional patent application No. 60/507,627 filed Oct. 1, 2003.

TECHNICAL FIELD

The present invention relates to antennas and more particularly to a dual frequency band antenna with omnidirectional radiation patterns.

BACKGROUND ART

Dual band omnidirectional antenna systems are useful for various wireless communications applications, particularly cellular infrastructure networks. Prior known dual band omnidirectional antenna arrays have been designed with two antenna arrays vertically stacked within a radome. Such vertically stacked arrays result in a long antenna. Other prior known dual band omnidirectional antennas, to reduce the overall length of a antenna, have two antennas arrays placed side-by-side within the same radome. Such side-by-side antenna arrays generally result in distorted radiation patterns for both bands in the azimuth plane due to interference effects that both antennas arrays experience from each other.

DISCLOSURE OF THE INVENTION

An omni-dualband antenna system includes an elongated cylindrical radome with an antenna inside the radome. The antenna has a linear first array of driven elements in a first plane, a linear second array of driven elements aligned with the first array and in a second plane that is parallel to the first plane, a linear third array of parasitic elements aligned with the elements of the second array and in a third plane that is parallel to the second plane, and a diplexer connected to the first and second arrays. The second plane is spaced a selected first distance from the first plane, and the third plane is spaced a selected second distance from the second plane. The elements of the first array are sized for first frequency band, and the elements of the second and third arrays are sized for a second frequency band that is higher than the first frequency band.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
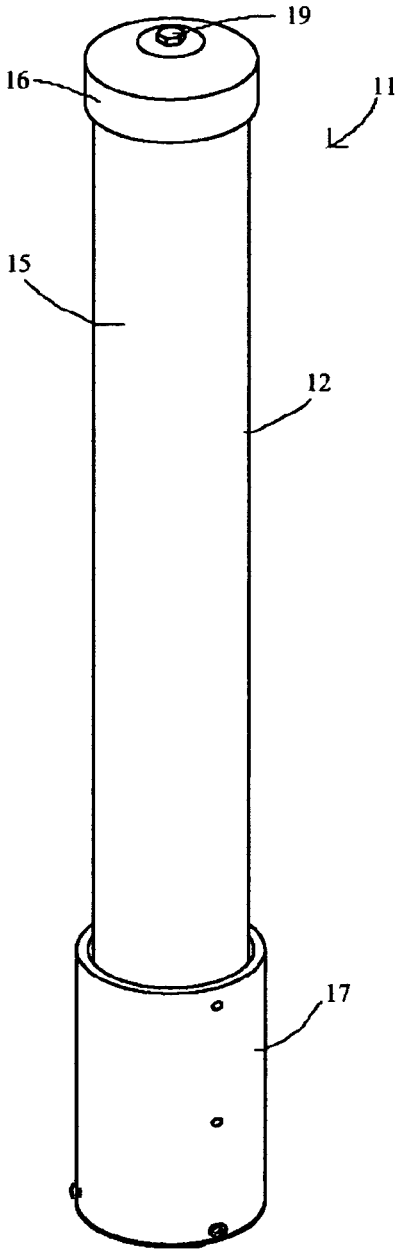
FIG. 1 a front perspective of an antenna system embodying features of the present invention.
Figure 2:
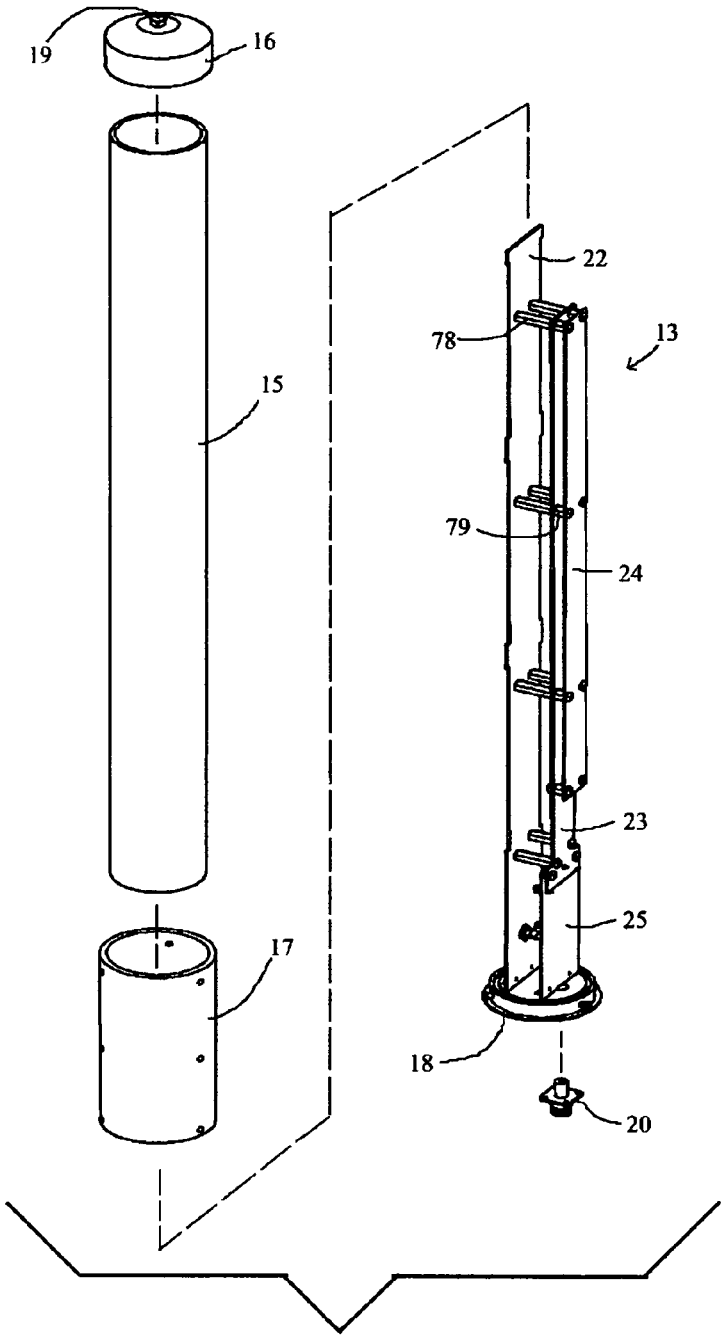
FIG. 2 is an exploded view of the system of FIG. 1.

Referring to FIGS. 1 and 2, an antenna system 11 embodying features of the present invention includes a radome 12 and an antenna 13. The radome 12 has a vertically elongated, hollow, cylindrical radome tube 15, an upper radome cap 16 that fits over the upper end of the radome tube 15, a mast 17 that fits around the bottom of the radome tube 15, and a lower radome cap 18 that fits into the bottom end of the radome tube 15. A weep hole plug 19 plugs a weep hole provided in the upper radome cap 16. Connector 20 extends through the lower radome cap 18.

Describing the specific embodiments herein chosen for illustrating the invention, certain terminology is used which will be recognized as being employed for convenience and having no limiting significance. For example, the terms "horizontal", "vertical", "upper", and "lower" refer to the illustrated embodiment in its normal position of use. Further, all of the terminology above-defined includes derivatives of the word specifically mentioned and words of similar import.

Figure 3:
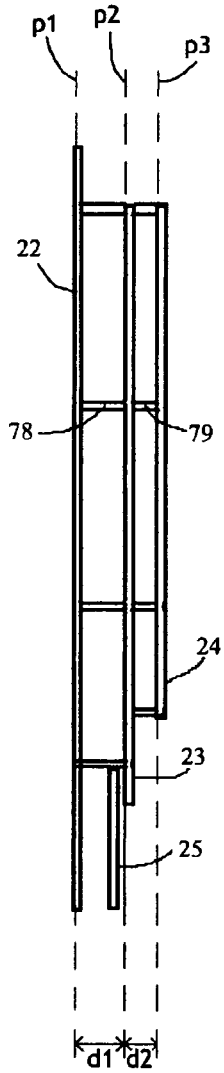
FIG. 3 is a side elevation view of the antenna of the system of FIG. 1.

As shown in FIGS. 2 and 3, the antenna 13 includes spaced, first, second and third arrays 22, 23 and 24, and a diplexer 25. The first and second arrays 22 and 23 each connect to the diplexer 25, and are arrays of driven elements. The third array 24 is an array of parasitic elements. Each of the first, second and third arrays 22, 23 and 24 is vertically elongated. The first array 22 is substantially in a first plane p1, the second array 23 is substantially in a second plane p2 that is parallel to the first plane p1, and the third array 24 is substantially in a third plane p3 that is parallel to the second plane p2, opposite the first plane pl. The first, second and third arrays 22, 23 and 24 are aligned. The second plane p2 is spaced a selected first distance d1 from the first plane p1 and the third plane p3 spaced a selected second distance d2 from the second plane p2. In the illustrated embodiment, the diplexer 25 connects to the lower ends of the first and second arrays 22 and 23.

Figure 4A:
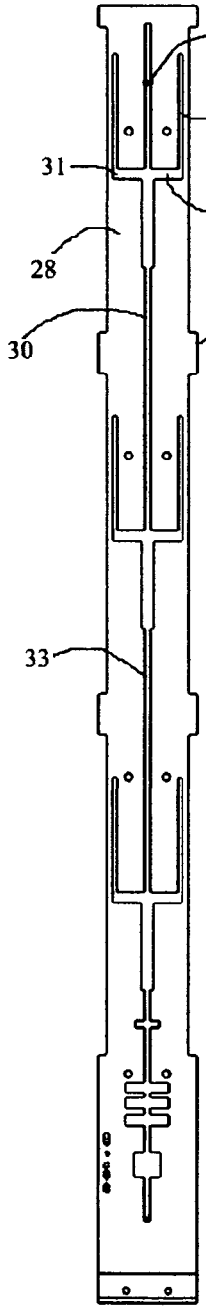
FIGS. 4A and 4B are elevation views of opposite sides of a first array for the antenna of the system of FIG. 1.
Figure 4B:
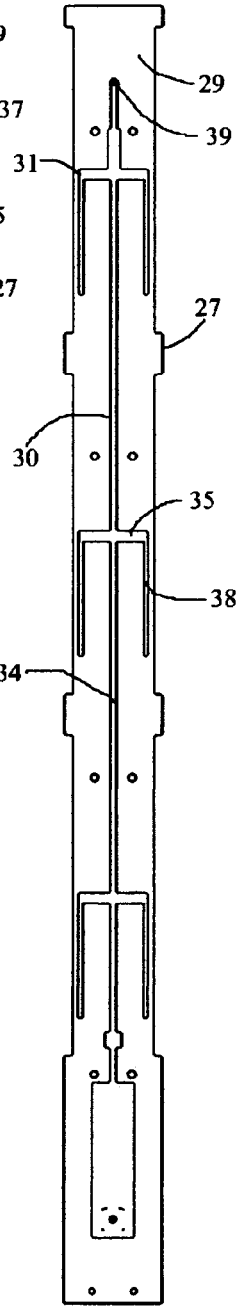

Referring to FIGS. 4A and 4B, the first array 22 includes a substantially planar, elongated first substrate 27 having spaced, oppositely facing first and second sides 28 and 29, a first feed structure 30 and a plurality of first elements 31. The first feed structure 30 includes a relatively narrow, flat, conductive first feed line 33 attached to and extending longitudinally substantially along the center of the first side 28 from the bottom to near the top. The first feed structure 30 also includes a relatively narrow, flat, conductive second feed line 34 attached to and extending longitudinally substantially along the center of the second side 29 from the bottom to near the top. Conductive side feeds 36 extend transversely from both sides of the first and second feed lines 33 and 34, with the side feeds 36 of the second side 29 being opposite or aligned with the side feeds 36 on the first side 28.

In the illustrated embodiment, the first elements 31 are bifurcated dipoles. The first elements 31 each include two first portions 37 and two second portions 38. The first and second portions 37 and 38 are relatively narrow, vertical strips of flat, conductive material. The first portions 37 are attached on the first side 28 on opposite sides of the first feed line 33, each connecting at an end to a side feed 36 and extending upwardly. The second portions 38 are attached on the second side 29 on opposite sides of the second feed line 34, each connecting at an end to a side feed 36 and extending downwardly. The second feed line 34 is connected to the first feed line 33 by a conductive via 39 that extends through the first substrate 27 near the upper end of the second feed line 34, to ground the first array 22 and thereby DC isolate the first array 22.

Figure 5A:
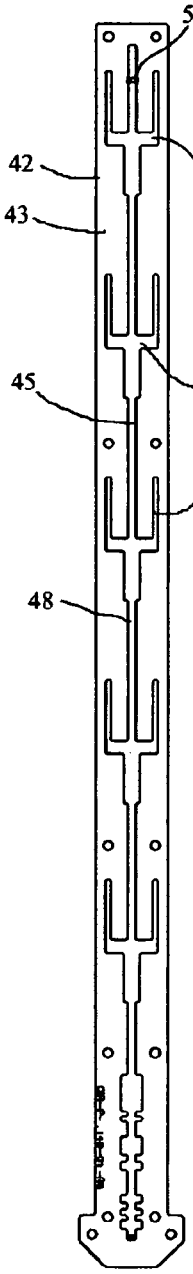
FIGS. 5A and 5B are elevation views of opposite sides of a second array for the antenna of the system of FIG. 1.
Figure 5B:
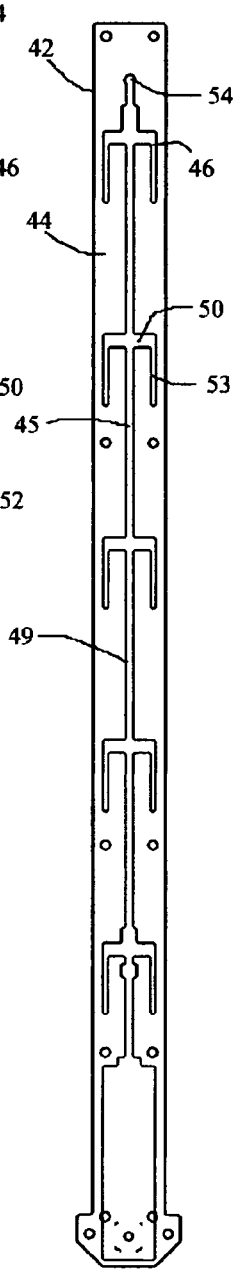

Referring to FIGS. 5A and 5B, the second array 23 includes a substantially planar, elongated second substrate 42 having spaced, oppositely facing first and second sides 43 and 44, a second feed structure 45 and a plurality of second elements 46. The second feed structure 45 includes a relatively narrow, flat, conductive first feed line 48 attached to and extending longitudinally substantially along the center of the first side 43 from the bottom to near the top. The second feed structure 45 also includes a relatively narrow, flat, conductive second feed line 49 attached to and extending longitudinally substantially along the center of the second side 44 from the bottom to near the top. Conductive side feeds 50 extend transversely from both sides of the first and second feed lines 48 and 49, with the side feeds 50 of the second side 44 being opposite or aligned with the side feeds 50 on the first side 43.

The second elements 46 shown are bifurcated dipoles. The second elements 46 each include two first portions 52 and two second portions 53. The first and second portions 52 and 53 are relatively narrow, vertical strips of flat, conductive material. The first portions 52 are attached on the first side 43 on opposite sides of the first feed line 48, each connecting at an end to a side feed 50 and extending upwardly. The second portions 53 are attached on the second side 44 on opposite sides of the second feed line 49, each connecting at an end to a side feed 50 and extending downwardly. The second feed line 49 is connected to the first feed line 48 by a conductive via 54 that extends through the second substrate 42 near the upper end of the second feed line 49, to ground the second array 23 and thereby DC isolate the second array 23.

The first and second elements 31 and 46 are shown in the illustrated embodiment as bifurcated dipoles formed by printed circuit methods or printed on the first and second substrates 27 and 42, respectively. The first and second elements 31 and 46 can be other types of dipole, other patch elements on a substrate or other types of elements without the substrate. Although the first and second 31 and 46 are shown and described above as serially connected, the first and second feed structures 30 and 45 can be serial, corporate or a combination of both.

Figure 6:
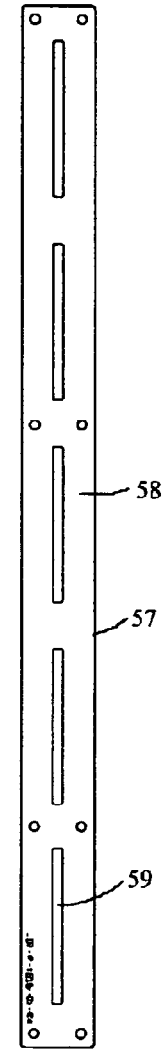
FIG. 6 is front elevation view of a third array for the antenna of the system of FIG. 1.

FIG. 6 shows the third array 24 including a third substrate 57 with a planar first side 58, and a plurality of third elements 59. The third elements 59 are relatively narrow, vertical, substantially rectangular strips of flat, conductive material attached on the first side 58 and vertically spaced along the center of the first side 58. The number of third elements 59 is equal to the number of second elements 46, and are spaced such that when the antenna 13 is assembled, a third element 59 is vertically aligned with each second element 46.

The first elements 31 are sized for a first frequency band. The second and third elements 46 and 59 are sized for a second frequency band. By way of example, and not as a limitation, for a cellular infrastructure network, the first frequency band is centered about 850 MHz and the second frequency band is centered about 1900 MHz. Preferably the first frequency band is lower than the second frequency band. A lower frequency band antenna is electrically large relative to a higher frequency band antenna, and the higher frequency band will typically be influenced by the lower frequency band antenna. Therefore the higher frequency band radiation pattern will be more distorted than the lower frequency band. The size, shape and spacing of the third elements 59, relative to the second elements 46, is selected to couple with the second elements 46 to reshape and correct the radiation pattern for the second frequency band.

Figure 7A:
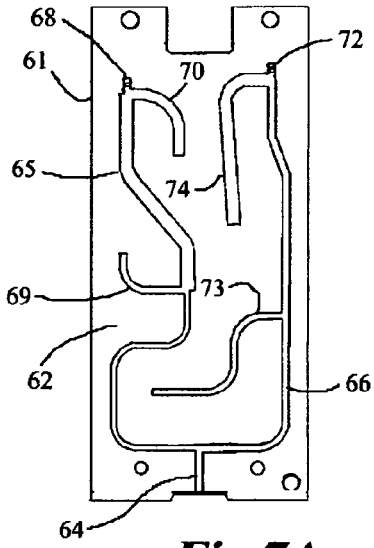
FIGS. 7A and 7B are elevation views of opposite sides of a diplexer for the antenna of the system of FIG. 1.
Figure 7B:
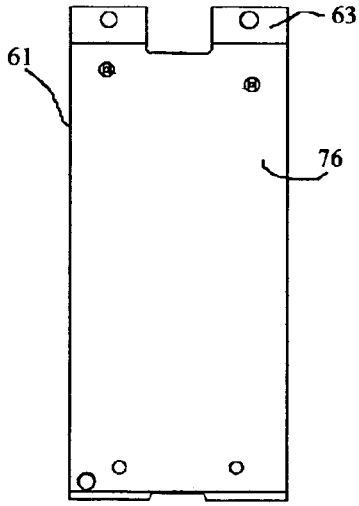

FIGS. 7A and 7B show the diplexer 25 having a fourth substrate 61 having spaced, planar first and second sides 62 and 63, a conductive common feed path 64 attached to the first side 62, and conductive first and second array feed paths 65 and 66 attached to the first side 62. The common feed path 64 extends a short distance upwardly from the center of the lower end of the first side 62. The first array feed path 65 connects to the upper end of the common feed path 64 and extends upwardly in a somewhat meandering manner on the left half of the first side 62, first going left, then up, then right, then up, then slanting up and left, and then up to terminate at a first aperture 68 near the upper end of the first side 62. A conductive first stub 69 is attached to the first side 62 and connects to the middle of the first array feed path 65, extending leftwardly and then curving upwardly. A conductive second stub 70 is attached to the first side 62 and connects to the upper end of the first array feed path 65, extending rightwardly and then curving downwardly.

The second array feed path 66 connects to the upper end of the common feed path 64 and extends upwardly in a somewhat meandering manner on the right half of the first side 62, first going right, then up, then slanting up and left, and then up to terminate at a second aperture 72 near the upper end of the first side 62. A conductive third stub 73 is attached to the first side 62 and connects to the middle of the second array feed path 66, extending leftwardly, then curving downwardly, and then curving leftwardly again. A conductive fourth stub 74 is attached to the first side 62 and connects to the upper end of the second array feed path 66, extending leftwardly and then curving downwardly. The lengths of the first array feed path 65 and the first and second stubs 69 and 70 are selected so that signals in the first frequency band are transmitted along the first array feed path 65 and signals in the second frequency band are rejected. The lengths of the second array feed path 66 and the third and fourth stubs 73 and 74 are selected so that signals in the second frequency band are transmitted along the second array feed path 66 and signals in the first frequency band are rejected. The second side 63 is covered with a ground plane 76.

The antenna 13 is assembled with the first feed line 33 of the first array 22 connected to the first array feed path 65 at the first aperture 68 and the second feed line 34 of the first array 22 connected to the ground plane 76. The first feed line 48 of the second array 23 is connected to the second array feed path 66 at the second aperture 72 and the second feed line 49 of the second array 23 connected to the ground plane 76. Coaxial cable or other transmission line can be used to connect the diplexer 25 to the first and second arrays 22 and 23. The connector 20 connects to the lower end of the common feed path 64 and to the ground plane 76. The diplexer 25 provides common connection of the first and second arrays 22 and 23 to a single transmission line. Alternatively, the antenna 13 can be made without the diplexer 25 and two separate transmission lines can be used to connect to the first and second arrays 22 and 23.

Referring again to FIGS. 2 and 3, a plurality of first spacers 78 extend from the second side 29 of the first substrate 27 to the first side 43 of the second substrate 42, to hold the first and second arrays 22 and 23 spaced at the selected first distance d1. A plurality of second spacers 79 extend from the second side 44 of the second substrate 42 to the first side 58 of the third substrate 57, to hold the second and third arrays 23 and 24 spaced at the selected second distance d2. In the illustrated embodiment, with the first frequency band of 850 MHz and the second frequency band of 1900 MHz, the first distance d1 is 1.25 inches and the second distance is 0.375 inches. With the antenna 13 as described, the first array 22 has an omnidirectional radiation pattern at the first frequency band and the second array 23 has an omnidirectional radiation pattern at the second frequency band.

Although the present invention has been described with a certain degree of particularity, it is understood that the present disclosure has been made by way of example and that changes in details of structure may be made without departing from the spirit thereof.

What is claimed is:

1. A dual band, omnidirectional antenna comprising:

a first array having a plurality of linearly arranged first elements with a first frequency band and a first feed structure connecting said first elements, said first array being substantially in a first plane, a second array having a plurality of linearly arranged second elements with a second frequency band and a second feed structure connecting said second elements, said second array being aligned with said first array and substantially in a second plane that is parallel to and spaced a selected first distance from said first plane, and a third array having a plurality of linearly arranged parasitic third elements, said third array being aligned with said second array and substantially in a third plane that is parallel to and spaced, opposite said first plane, a selected second distance from said second plane, whereby said first array has an omnidirectional radiation pattern at said first frequency band and said second array has an omnidirectional radiation pattern at said second frequency band.

2. The antenna as set forth in claim 1 wherein:

said first array includes an elongated first substrate having spaced, oppositely facing first and second sides, with said first elements being made of planar conductive material attached to at least one of said first and second sides, said second array includes an elongated second substrate having spaced, oppositely facing first and second sides, with said second elements being made of planar conductive material attached to at least one of said first and second sides, and said third array includes an elongated third substrate having spaced, oppositely facing first and second sides, with said third elements being made of planar conductive material attached to one of said first and second sides.

3. The antenna as set forth in claim 2 wherein said first elements are printed dipoles on said first substrate and said second elements are printed dipoles on said second substrate.

4. The antenna as set forth in claim 3 wherein said first elements are bifurcated dipoles on said first substrate and said second elements are bifurcated dipoles on said second substrate.

5. The antenna as set forth in claim 4 wherein:

said first elements include bifurcated dipole first portions on said first side of said first substrate and bifurcated dipole second portions on said second side of said first substrate, and said second elements include bifurcated dipole first portions on said first side of said second substrate and bifurcated dipole second portions on said second side of said second substrate.

6. The antenna as set forth in claim 2 wherein said first feed structure includes a first feed line extending longitudinally along said first side of said first substrate, and said second feed structure includes a first feed line extending longitudinally along said first side of said second substrate.

7. The antenna as set forth in claim 6 wherein: said first feed structure includes a second feed line extending longitudinally along said second side of said first substrate with said second feed line connecting near an end to said first feed line to provide DC isolation for said first array, and said second feed structure includes a second feed line extending longitudinally along said second side of said second substrate with said second feed line connecting near an end to said first feed line to provide DC isolation for said second array.

8. The antenna as set forth in claim 2 including a plurality of first spacers between said first and second substrates to maintain said first distance and a plurality of second spacers between said second and third substrates to maintain said second distance.

9. The antenna as set forth in claim 1 wherein the number of said third elements in said third array is equal to the number of said second elements in said second array, and each said third element is aligned with a said second element.

10. The antenna as set forth in claim 1 wherein said first array includes three said first elements, said second array includes five said second elements and said third array includes five said third elements.

11. The antenna as set forth in claim 1 wherein said second frequency band is higher than said first frequency band.

12. The antenna as set forth in claim 1 wherein said first frequency band is centered about 850 MHz and said second frequency band is centered about 1900 MHz, and said first distance is about 1.25 inch and said second distance is about 0.375 inch.

13. The antenna as set forth in claim 1 including a diplexer connected to said first and second feed structures to provide common connection of said first and second arrays to a transmission line.

14. The antenna as set forth in claim 1 wherein said first elements are serially connected by said first feed structure and said second elements are serially connected by said second feed structure.

15. A dual band, omnidirectional antenna comprising:

a first array having an elongated, substantially planar first substrate with spaced, oppositely facing first and second sides, a first feed structure with flat, conductive first and second feed lines extending longitudinally along said first and second sides of said first substrate, respectively, a plurality of spaced, linearly arranged, conductive, flat, bifurcated dipole first portions on said first side of said first substrate and serially connected to said first feed line, and a plurality of spaced, linearly arranged, conductive, flat, bifurcated dipole second portions on said second side of said first substrate and serially connected to said second feed line, said first portions being aligned with said second portions to form first elements, said first elements having a first frequency band, a second array having an elongated, substantially planar second substrate with spaced, oppositely facing first and second sides, a second feed structure with conductive first and second feed lines extending longitudinally along said first and second sides of said second substrate, respectively, a plurality of spaced, linearly arranged, conductive, bifurcated dipole first portions on said first side of said second substrate and serially connected to said first feed line, and a plurality of spaced, linearly arranged, conductive, bifurcated dipole second portions on said second side of said second substrate and serially connected to said second feed line, said first portions being aligned with said second portions to form second elements, said second elements having a second frequency band that is higher than said first frequency band, said second substrate being aligned with, parallel to, and spaced a selected first distance from said first substrate, a third array having an elongated, substantially planar third substrate with spaced, oppositely facing first and second sides, and a plurality of conductive , flat, linearly arranged parasitic third elements on one of said first and second sides, said third substrate being aligned with, parallel to and spaced, opposite said first substrate, a selected second distance from said second substrate a plurality of first spacers that extend from said second side of said first substrate to said first side of said second substrate to maintain said first distance, a plurality of second spacers that extend from said second side of said second substrate to said first side of said third substrate to maintain said second distance, and a diplexer connected to said first and second feed structures to provide common connection of said first and second arrays to a transmission line, whereby said first array has an omnidirectional radiation pattern at said first frequency band and said second array has an omnidirectional radiation pattern at said second frequency band.

16. A dual band, omnidirectional antenna system comprising:

a dual band, omnidirectional antenna including;

a first array having a plurality of linearly arranged first elements with a first frequency band and a first feed structure connecting said first elements, said first array being substantially in a first plane, a second array having a plurality of linearly arranged second elements with a second frequency band and a second feed structure connecting said second elements, said second array being aligned with said first array and substantially in a second plane that is parallel to and spaced a selected first distance from said first plane, and a third array having a plurality of linearly arranged parasitic third elements, said third array being aligned with said second array .and substantially in a third plane that is parallel to and spaced, opposite said first plane, a selected second distance from said second plane, and a diplexer connected to said first and second feed structures, and a radome having an elongated, cylindrical radome tube, an upper end cap attached over an upper end of said tube, and a lower end cap attached over a lower end of said tube, said radome being sized and shaped to fit over said antenna with said diplexer at said lower end cap, said radome including a connector connected to said diplexer and extending through said lower end cap to provide common connection of said first and second arrays to a transmission line, whereby said first array has an omnidirectional radiation pattern at said first frequency band and said second array has an omnidirectional radiation pattern at said second frequency band.

* * * * *